US007123866B2

(12) United States Patent
Swift

(10) Patent No.: US 7,123,866 B2
(45) Date of Patent: Oct. 17, 2006

(54) ELECTROSTATIC DEVELOPMENT BELT

(75) Inventor: Joseph A. Swift, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/003,665

(22) Filed: Dec. 3, 2004

(65) Prior Publication Data

US 2006/0120770 A1 Jun. 8, 2006

(51) Int. Cl.
*G03G 15/08* (2006.01)

(52) U.S. Cl. ..... 399/288

(58) Field of Classification Search ..... 399/288, 399/265, 279, 286

See application file for complete search history.

(56) References Cited

U.S. PATENT DOCUMENTS

| | | | |
|---|---|---|---|
| 5,717,986 A | 2/1998 | Vo et al. | |
| 5,893,015 A | 4/1999 | Mojarradi et al. | |
| 6,042,917 A * | 3/2000 | Schlueter et al. | 428/60 |
| 6,437,282 B1 | 8/2002 | Thornton et al. | |

* cited by examiner

*Primary Examiner*—Sandra L. Brase
(74) *Attorney, Agent, or Firm*—Eugene O. Palazzo; Fay, Sharpe, Fagan, Minnich & McKee, LLP

(57) ABSTRACT

An apparatus in which an electrostatic latent image is developed with toner. A donor belt is adapted to provide toner to develop the image. The donor belt includes a lower layer and a thermoplastic layer. The lower layer can include materials to regulate conductive properties. The thermoplastic layer joins the ends of the donor belt together using an overlapping butt seam. A layer of electrodes is spaced across the width of the donor belt.

12 Claims, 3 Drawing Sheets

ELECTROSTATIC DEVELOPMENT BELT

BACKGROUND

Illustrated herein in embodiments are development apparatuses for ionographic or electrophotographic imaging and printing, and more particularly, endless seamed electrostatic development belts comprised of at least two layers and joined by an overlapping seam. When electrodes are incorporated, the belt can be used to charge and transport toner on the surface thereof and to form a toner cloud in the development zone for the development of a latent electrostatic image.

In this regard, the process of electrophotographic imaging and printing includes charging a photoconductive member to a substantially uniform potential so as to sensitize the surface thereof. The charged portion of the photoconductive surface is exposed to alight image of an original document being reproduced. This records an electrostatic latent image on the photoconductive surface. After the electrostatic latent image is recorded on the photoconductive surface, the latent image is developed by bringing a developer material into contact with the image.

Two-component and single-component developer materials are commonly used in the development process. A typical two-component developer material comprises magnetic carrier granules having toner particles adhering triboelectrically thereto. A single-component developer material typically comprises only toner particles. In either type of material, the toner particles are attracted to the latent image and form a toner powder image in the vicinity of the photoconductive surface. Under the influence of the image field, the toner is developed onto the photoconductor. The toner powder image is subsequently transferred to a substrate such as a copy sheet. The toner powder image is then heated to permanently fuse it to the substrate.

The electrophotographic development process noted above can also be modified to produce color images. One color electrophotographic development/marking process, called image-on-image processing, superimposes toner powder images of different color toners onto the photoreceptor prior to the transfer of the composite toner powder image onto the substrate. While the image-on-image process is beneficial, it has several problems. For example, when recharging the photoreceptor in preparation for creating another color toner powder image it is important to level the voltages between the previously toned and the untoned areas of the photoreceptor. This requires an additional process step that can affect subsequent development steps as well as the print quality of the resultant print.

Single-component development systems typically use a donor member for transporting charged toner to the development nip defined by the donor member and a photoconductive member. The toner is developed on the latent image recorded on the photoconductive member by a combination of mechanical and/or electrical forces.

Scavengeless development and jumping development are two types of single-component development. A scavengeless development system uses a donor member with a plurality of electrodes closely spaced therefrom in the development zone. An AC voltage is applied to the electrodes forming a toner cloud in the development zone. The electrostatic fields generated by the latent image attract toner from the toner cloud to develop the latent image.

In jumping development, an AC voltage is applied to the donor member, detaching toner from the donor member and projecting the toner toward the photoconductive member so that the electrostatic fields generated by the latent image attract the toner to develop the latent image. Single-component development systems offer advantages in low cost and design simplicity, but the achievement of high reliability and simple economic manufacturability continue to present problems.

Additionally, the donor member is frequently in the form of a flexible electrostatic development or donor belt. These belts can be formed by cutting a rectangular, a square, or a parallelogram shape sheet from a web containing at least one layer of thermoplastic polymeric material. Opposite ends of the sheet are then overlapped and joined together by compression and ultrasonic, adhesive, or thermal bonding to form a seam. When compression is combined with thermal bonding, the process for securing the seam is referred to as molding. When compression is combined with an adhesive(s) to secure the seam this process is referred to as adhesive bonding. The seam typically extends from one edge of the belt to the opposite edge.

Generally, these donor belts comprise at least a supporting substrate layer and at least one layer comprising a thermoplastic polymeric material. However, it has been found that, during extensive cycling, the seam area may break down due to fatigue, etc., thereby shortening the service life of the donor belt.

Therefore, there is a need to provide seamed flexible donor belts with an improved seam morphology which can withstand greater dynamic fatigue conditions thereby extending belt service life. Furthermore, there is also a need for donor belts having improved seam designs that are thin in seam profile, resistant to seam cracking/delamination, substantially free of seam protrusions, and have improved seam region physical and electrical continuity.

BRIEF DESCRIPTION

The present disclosure obviates one or more of the difficulties noted above by providing an electrostatic development or donor belt having high reliability and simple economic manufacturability. The disclosure also enables high speed development with a donor belt which makes possible the use of a smaller and more efficient development housing within a printing machine.

In an additional embodiment, a flexible donor belt is provided having an improved seam that is welded, molded, or bonded, which exhibits greater resistance to seam cracking and/or delamination. The flexible donor belt has an improved seam which provides good circumferential dimension tolerance and robust mechanical seam function.

In a further embodiment, a donor belt is provided comprising a flexible electrostatic multi-layer substrate comprising at least one thermoplastic layer and at least one lower layer having electrical conductive properties. The donor belt includes a plurality of spaced apart electrodes extending substantially across the width of the outer surface of the donor belt. It is substantially free of seam protrusions and has a relatively smooth surface morphological profile. The donor belt also has means to charge and to move toner particles to and from a development zone and means for electrically biasing said electrodes in said development zone to detach said toner particles from said donor belt so as to form a toner cloud for developing a latent image.

In another embodiment, an apparatus is provided for developing a latent image recorded on an imaging surface comprising a housing defining a chamber storing a supply of developer material comprising toner and a donor belt spaced from the imaging surface and being adapted to transport toner on the surface thereof to a region opposed from the imaging surface. The donor belt comprises a flexible electrostatic multi-layer substrate comprising at least one thermoplastic layer and at least one lower layer having conductive properties. The donor belt includes a plurality of spaced apart electrodes extending substantially across the width of the outer surface of the donor belt. It has an enhanced seam which has little or no seam region discontinuity. The donor belt has means to move toner particles to and from a development zone and means for electrically biasing said electrodes in said development zone to detach said toner particles from said donor belt so as to form a toner cloud for developing a latent image recorded on a photoconductive member. The toner particle image is subsequently transferred to a substrate such as a copy sheet.

In a still further embodiment, an electrophotographic printing machine is provided, wherein an electrostatic latent image recorded on an imaging surface of a photoconductive member is developed to form a visible image thereof, wherein the printing machine includes a housing defining a chamber storing a supply of developer material comprising toner and a donor belt spaced from the imaging surface and being adapted to transport toner on the surface thereof to a region opposed from the imaging surface. The donor belt comprises a flexible electrostatic multi-layer substrate comprising at least one thermoplastic layer and at least one lower layer having conductive properties. The donor belt includes a plurality of spaced apart electrodes extending substantially across the width of the outer surface of the donor belt. It has an improved seam area thickness to minimize seam region induced bending stress. The donor belt has means to move toner particles to and from a development zone and means for electrically biasing said electrodes in said development zone to detach said toner particles from said donor belt so as to form a toner cloud for developing the latent image.

In an additional embodiment, a process for producing a seamed, flexible donor belt is provided. The process includes providing a flexible, substantially rectangular, donor sheet having a first major exterior surface opposite and parallel to a second major exterior surface and a first marginal end region of said sheet opposite and parallel with a second marginal end region. The donor sheet comprises a thermoplastic upper layer and a conductive lower layer. The thermoplastic upper layer of the first marginal end region is then shaped at a substantially 90° angle to form a first new angular surface between the first major exterior surface and the second major exterior surface. The thermoplastic upper layer and the conductive lower layer of the second marginal end region are also shaped at a complementary substantially 90° angle to form a second new surface between the first major exterior surface and the second major exterior surface, wherein the second new surface is substantially the opposite of the first new surface. The shaped sheet is then formed into a loop and the first new surface is overlapped with the second new surface to form a mated region. The first new surface is joined to the second new surface in the mated region to form a seam. Although the bonding of the mated surfaces of the end pair of the donor belt into a seamed belt can be accomplished by gluing, solvent welding, ultrasonic welding process, thermal bonding and the like, nonetheless ultrasonic and thermal seam welding are the processes of particular preference based on the ease of operation, seam bonding strength, and economic considerations. Also disclosed herein is the seamed, flexible donor belt produced by these processes.

In a further embodiment, there is disclosed a process comprising providing a flexible, substantially rectangular sheet having a first major exterior surface opposite and parallel to a second major exterior surface; removing or displacing material from the first major exterior surface adjacent and parallel to a first edge of the sheet, wherein the material is removed or displaced on a substantially 90° angle between the first major exterior surface and the second major exterior surface to form a new first angled surface; removing or displacing material from the second major exterior surface adjacent and parallel to a second edge of the sheet, wherein the material is also removed or displaced on a substantially 90° angle between the second major surface and the first major exterior surface to form a new second angled surface; overlapping the new first angled surface with the new second angled surface; and securing or joining the new first angled surface with the new second angled surface to form a seam.

Another embodiment disclosed herein is a flexible donor belt having an angled, cross-sectional seam. The flexible donor belt is produced by bisecting both ends of a flexible, substantially rectangular donor sheet at a 90° angle relative to the first and second major exterior surfaces of the sheet. The sheet is looped and the angled ends are then overlapped, mated, and joined or fused together to form a flexible donor belt. The 90° angled cross-sectional seam so produced exhibits improved strength in comparison to conventional overlapped seams with several morphological improvements.

In a still further embodiment, an ultrasonically welded, butt-lap seamed flexible donor belt is generated by producing a substantially rectangular flexible donor sheet having two opposite ends, bisecting the opposite ends of the sheet at a cross-sectional 90° angle relative to the sheet's first and second major exterior surfaces to generate a pair of matching, or complementary, 90° angles, forming a loop with the sheet and bringing the opposite ends together for mating, and ultrasonically welding the mated opposite ends together to form a thin and smooth profile welded seam having an angled butt-lap seam morphology.

Such a result can also alternatively be achieved by angularly removing or displacing by various methods, such as ablation, grinding, etc., material from the two opposite ends of a flexible, substantially rectangular donor sheet. These processes are utilized to produce the desired, matched or complementary angled end shapes. The desired angled end shapes are then overlayed, mated and joined, such as by ultrasonic welding to produce a butt-lap seam. The resulting flexible donor belt has a smooth surface profile, a significant reduction in seam region thickness, and provides seam region physical continuity as well.

In yet another embodiment, a flexible donor belt is provided. The donor belt comprises a thermoplastic upper layer overlaying a conductive lower layer and a first end and a second end. The first end is configured in a manner to provide a first tongue. The first tongue may be formed by removing a rectangle from the lower surface of the upper layer and the conductive lower layer having a length L and a height H. The second end is configured in a manner to provide a mating second tongue. The second tongue may be formed by removing a rectangle having a length $L_2$ and a height $H_2$, wherein $H_2$ may be greater than, equal to, or less than H1 depending upon the relative thicknesses T1 and T2, and $L_1$ and $L_2$ are substantially equal. The belt is formed by joining the first tongue with the second tongue to form an overlapping belt seam.

The above processes, compositions and materials can be utilized to produce a seamed flexible donor belt having a sufficient strength, smooth surface profile with little, if any, increase in seam thickness.

BRIEF DESCRIPTION OF THE DRAWINGS

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the flexible donor belts or components thereof and/or to define or limit the scope of the exemplary embodiments.

Figure 1:
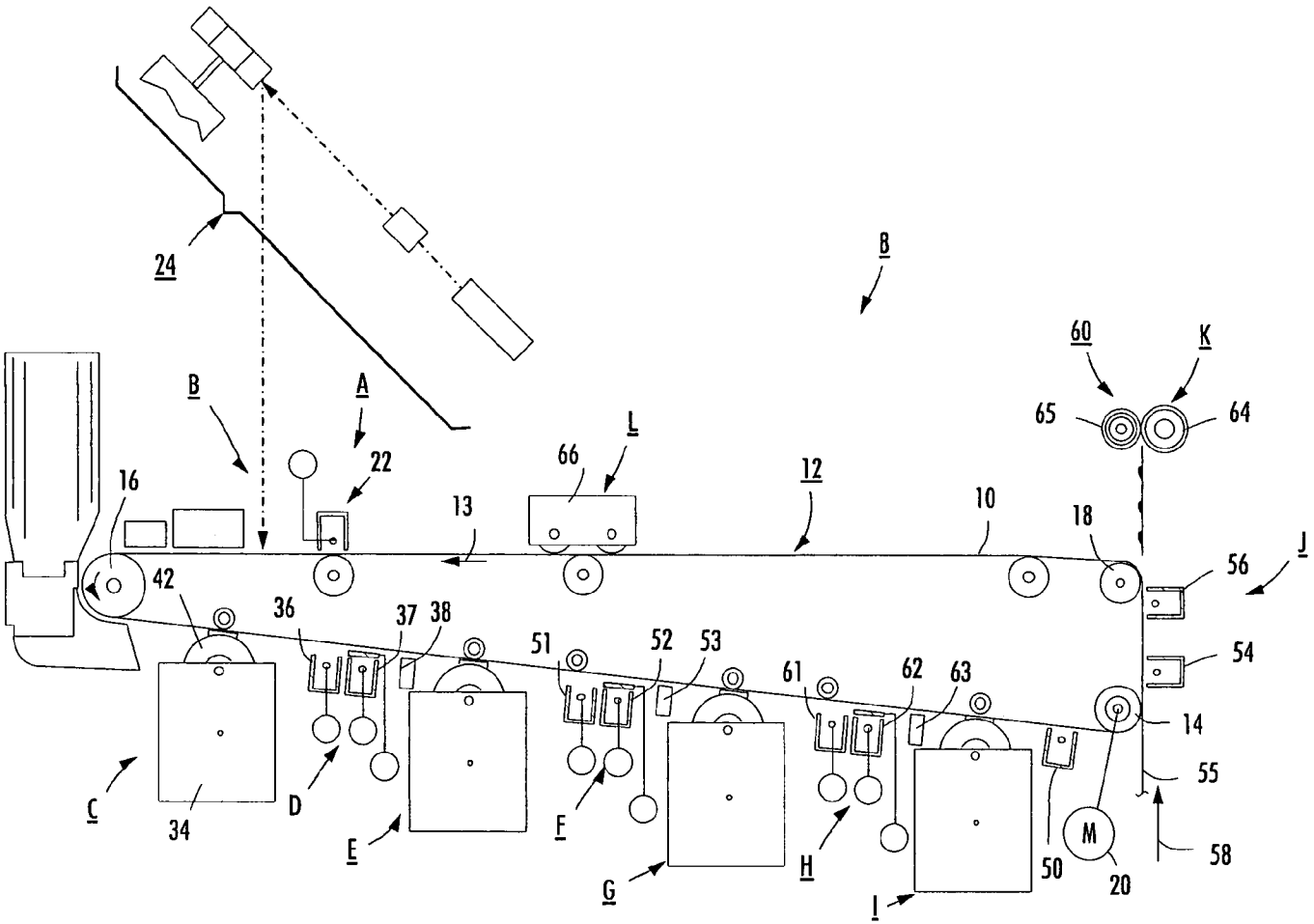
FIG. 1 shows an electrophotographic printing machine incorporating a developing apparatus.

Still further advantages and benefits of the present exemplary embodiments will become apparent to those of ordinary skill in the art upon reading and understanding the following detailed description of the preferred embodiments.

DETAILED DESCRIPTION

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Inasmuch as the art of electrophotographic printing is well known, the various processing stations employed in the printing machine will be shown hereinafter schematically and their operation described briefly with reference thereto.

Referring initially to FIG. 1, there is shown an illustrative electrophotographic machine having incorporated therein the development apparatus of the present disclosure. An electrophotographic printing machine creates a color image in a single pass through the machine and incorporates the features noted herein. The printing machine uses a charge retentive surface in the form of an Active Matrix (AMAT) photoreceptor belt 10 having a photoconductive surface 12 which travels sequentially through various process stations in the direction indicated by the arrow 13. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform surface potential. The image area is preferably negatively charged. However, it could be positively charged if the charge levels and polarities of the toners, recharging devices, photoreceptor, and other relevant regions or devices are appropriately changed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present development.

After passing through the first exposure station B, the now exposed image area passes through a first development station C which is identical in structure with development system E, G, and I. The first development station C deposits a first color, say black, of negatively charged toner onto the image area. That toner is attracted to the less negative sections of the image area and repelled by the more negative sections. The result is a first toner powder image on the image area.

The developer apparatus 34 comprises a donor structure in the form of a belt 42. The donor structure 42 conveys charged toner particles 45 (shown, for example, in FIG. 2) deposited thereon to a development zone where the toner particles are formed into a toner cloud for selective deposition on images contained on the charge retentive surface. The developer in this case comprises black toner. Further details of the developer apparatus 34 will be provided hereinbelow.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged at the first recharging station D, the now substantially uniformly charged image area with its first toner powder image passes to a second exposure station 38. Except for the fact that the second exposure station illuminates the image area with a light representation of a second color image (for example, yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (for example, magenta) so as to create a third electrostatic latent image, the third exposure station 53 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (for example, cyan) so as to create a fourth electrostatic latent image, the fourth exposure station 63 is the same as the first, second, and third exposure stations B, 38, and 53. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 55 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 55. This causes the negatively charged toner powder images to move onto the support sheet 55. The transfer station J also includes a detack corona device 56 which facilitates the removal of the support sheet 55 from the printing machine 8.

After transfer, the support sheet 55 moves onto a conveyor (not shown) which advances that sheet to a fusing station K. The fusing station K includes a fuser assembly, indicated generally by the reference numeral 60, which permanently affixes the transferred powder image to the support sheet 55. Preferably, the fuser assembly 60 includes a heated fuser roller 65 and a backup or pressure roller 64. When the support sheet 55 passes between the fuser roller 65 and the backup roller 64 the toner powder is permanently affixed to the support sheet 55. After fusing, a chute, not shown, guides the support sheet 55 to a catch tray, also not shown, for removal by an operator.

After the support sheet 55 has separated from the photoreceptor belt 10, residual toner particles on the image area are removed at cleaning station L via a cleaning brush contained in a housing 66. Subsequent to cleaning, a discharge lamp (not shown) floods the photoconductive surface with light to dissipate any residual electrostatic charge remaining. The image area is then ready to begin a new marking cycle.

The various machine functions described above are generally managed and regulated by a controller which provides electrical command signals for controlling the operations described above.

Figure 2:
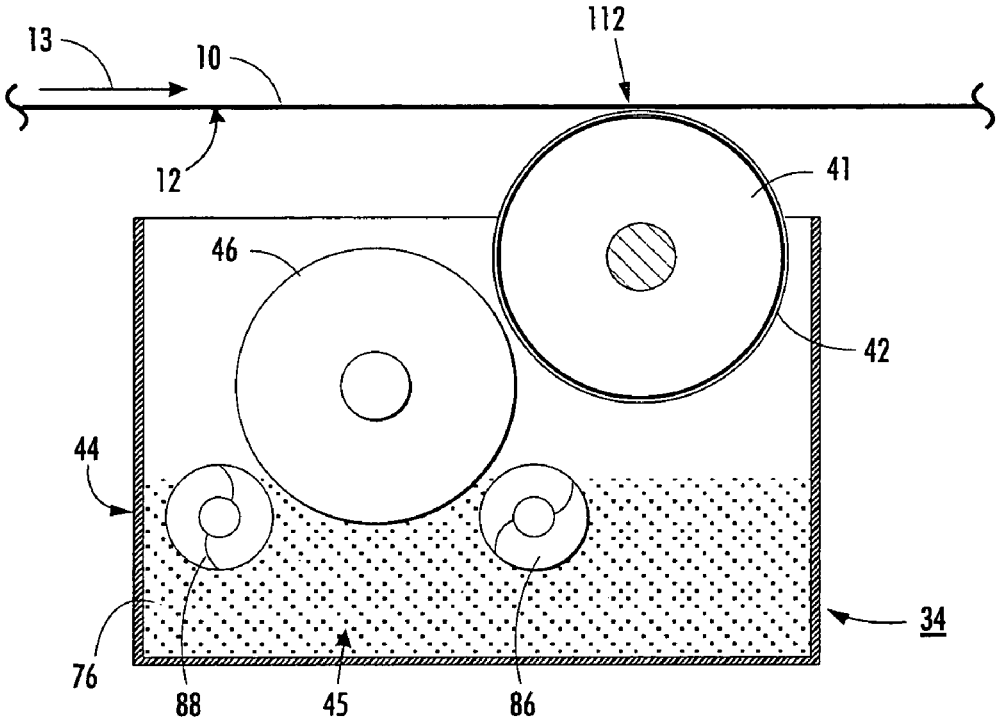
FIG. 2 shows a developing apparatus having features of the present disclosure.

FIG. 2 shows the development system, labeled in FIG. 1 with reference numeral 34, in greater detail. Here, photoreceptor belt 10 is traveling in the direction marked by arrow 13 with photoconductive surface 12 on the outside. Development system 34 includes a housing 44 defining a chamber 76 for storing a supply of developer material therein. Donor belt 42 is mounted on support roll 41. Support roll 41 and magnetic roller 46 are mounted in chamber 76 of housing 44. The magnetic roller 46 can be rotated in either the "with" or "against" direction relative to the direction of motion of the toner on donor belt. Similarly, the belt 42 carrying toner which is supported by the surface of roll 41 can be traveling in either the "with" or "against" direction relative to the direction of motion of the photoconductive belt. Alternatively, the donor belt 42 may be supported by two or more rollers where the belt is mounted therebetween and driven by at least one of the rollers. Development occurs when toner detaches from the surface of the donor belt 42 and forms a toner cloud 112, the height of the cloud being such as not to be substantially in contact with the belt 10, moving in direction 13. As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser. While in the chamber the toner particles are mixed with the carrier material by augers 86 and 88. In this manner, a substantially constant amount of toner particles are in the chamber of the developer housing with the toner particles.

Figure 3:
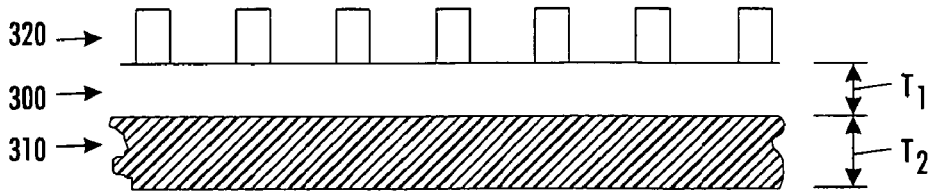
FIG. 3 is a cross-sectional view of an electrostatic development or donor belt showing the layers of the multi-layer substrate.

The donor belt 42 comprises a flexible electrostatic multilayer substrate comprising at least one thermoplastic layer and at least one lower layer having conductive properties. As seen in FIG. 3, the thermoplastic layer 300 is placed on top of the lower layer 310 and additional layers, such as a layer of electrodes 320, are placed on top of the thermoplastic layer. Additional layers, such as an anti-curl backing, may be placed below the lower layer 310 as well. Furthermore, friction controlling layers of suitable materials and topography and roughness can be applied to below layer 310 and be employed to adjust the frictional properties between the innermost surface of belt 42 and the outer surface of support roll 41. Further, additional layers of thin metal or other suitable electrical conductive material can be applied below layer 310. Alternatively, suitable solid or liquid lubricants can be applied to the innermost surface of belt 42 and located upon layer 310. The lower layer 310 has thickness $T_2$ and the upper thermoplastic layer 300 has thickness $T_1$.

The lower layer 310 is conductive. It can be made from any polymer, copolymer, polymer composite, or combination thereof. It may be a thermoplastic or a thermosetting polymer. It may be a rigid or flexible polymer, elastomer, or foam. Suitable materials include, but are not limited to, polyesters, polyurethanes, polyimides, polyvinyl chlorides, polyolefins (such as polyethylene and polypropylene) and/or polyamides (such as nylon), polycarbonates, or acrylics, or blends, or copolymers, or alloys of such materials. The lower layer is preferably composed of a polyimide such as DuPont Kapton™. If required, the selected material is modified by the addition of an appropriate filler such that the lower layer has a desired electrical conductivity. Appropriate fillers can include, for example, particulate carbon black, Accufluor™ fluorinated carbon black, carbon fiber, graphite, and/or other appropriate fillers such as polyanaline, polythiophene, or other conductive fillers or polymers. The filler type and concentration or loading should be chosen to impart the desired electrical conductivity and have minimal impact upon the physical and mechanical properties required of the belt. For example, if particulate carbon black is used in combination with polyimide at a concentration of between 30 and 35% by weight, the composite will have a volume resistivity (note that resistivity is the inverse of conductivity) in the range of about $1\times10^{(1)}$ to about $5\times10^{(-3)}$ ohm-cm, which is sufficient to dissipate any unwanted electrostatic charge build up and to provide a suitable ground plane reference to any electrodes 320 that may be employed at the upper surface of belt 42. Lower carbon black loadings can produce higher resistivity while having proportionately less impact upon the physical properties of layer 310, such as density. Conductive or ionic salts can also be used. The constituent material should have the physical characteristics appropriate to this application, including good tensile strength, resistivity (on the order of $\leqq 10^{12}$ ohm-cm), thermal conductivity, thermal stability, flex strength, and high temperature longevity. The lower layer can be of any thickness, however, ranges from about 0.1 mils to about 10 mils, preferably from about 0.5 mils to about 2 mils in thickness, are suitable for development donor belts. The lower layer can be prepared according to any suitable method.

The thermoplastic layer can be made of any film-forming thermoplastic polymer or combination of polymers. Suitable materials include, but are not limited to, polystyrene, polyester, polybutyl terepthalate (PBT), polyetheretherketone (PEEK), polyamide (nylon), polyethersulphone (PES), polycarbonate, polyphenylsulfide (PPS), polypropylene, polyethylene, polyurethane, copolymers, and blends thereof. Preferably, a polyimide such as DuPont Kapton KJ™ is used. The thermoplastic layer can be of any thickness, however, ranges from about 0.1 mils to about 10 mils in thickness, preferably from about 0.5 mils to about 4 mils in thickness are suitable for donor belts. The thickness of the thermoplastic layer is preferably greater than the thickness of the lower layer. The thermoplastic layer can be prepared according to any suitable method. While fillers may not be needed for this layer, appropriate fillers may optionally be used to adjust such properties as friction, tear resistance, elastic modulus, hardness, flame retardancy, topography, opacity, surface energy, and the like.

If desired, an adhesive layer may be added between the lower layer and the thermoplastic layer to bind them together. If included, the adhesive layer ranges from about 0.001 mils to about 1 mil in thickness, preferably from about 0.0025 mils to about 0.5 mils in thickness depending upon what adhesive characteristics are desired for this interface. Typical adhesive layers include film-forming polymers such as acrylic adhesives such as methacrylate resins, methacrylate copolymer resins, ethyl methacrylate resins, butyl methacrylate resins and mixtures thereof, polyesters, polyvinylbutyral, polyvinylpyrrolidone, polyurethane, polymethyl methacrylate and the like. Adhesives that are generally considered primers or coupling agents may also be used to bind the thermal plastic layer to the bottom layer.

Figure 4:
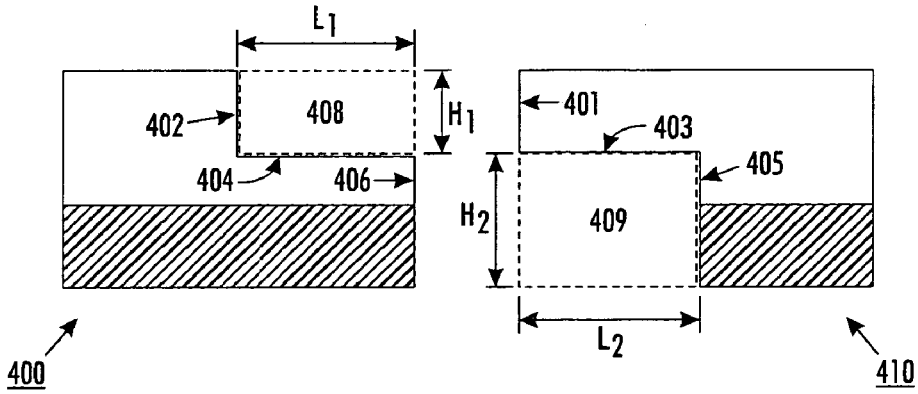
FIG. 4 is a cross-sectional view of a multi-layer substrate of the donor belt with the two end members used to form an overlapping butt seam.

FIG. 4 is a cross-sectional view of a multi-layer substrate. A donor belt is formed from a multi-layer substrate comprised of at least a thermoplastic layer of thickness $T_1$ and at least a lower layer of thickness $T_2$. It should be understood that a wide range of thicknesses can be used for each of the layers. The substrate has a first end 400 and a second end 410 that are shaped and mated to form a seam and form a donor belt. For example, the first end 400 has a first thick tongue that is formed by cutting out a rectangle 408 of length $L_1$ and height $H_1$ from the thermoplastic layer. Three new surfaces are created: a first outer surface 402, a first rabbet surface 404, and a first inner surface 406.

Similarly, the second end 410 has a thin tongue that is formed by cutting out a rectangle 409 of length $L_2$ and height $T_2+T_1-H_1$ from the lower layer and thermoplastic layer to create three new surfaces: a second outer surface 401, a second rabbet surface 403, and a second inner surface 405. These second new surfaces complement or match the first new surfaces created above. The rectangles may be cut out of the substrate using laser micro-machining as described in U.S. Pat. No. 6,437,282, which is hereby entirely incorporated by reference. Other suitable methods include mechanical milling or skiving, compressive thermal-forming, abrasive attrition, and the like.

Figure 5:
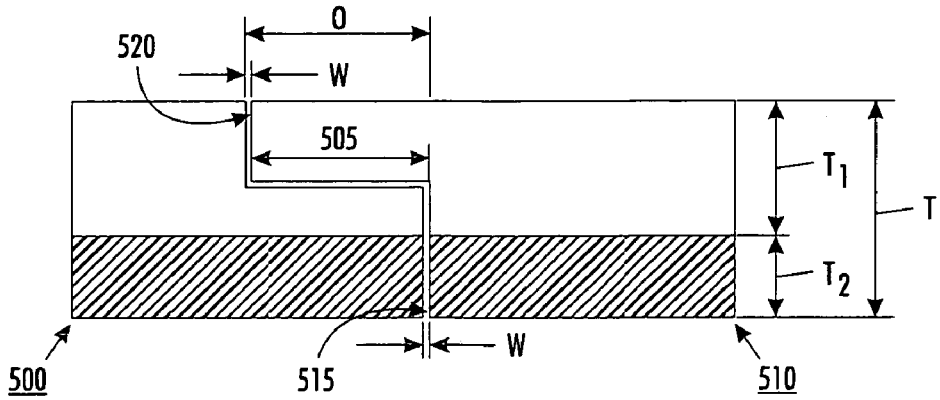
FIG. 5 shows the overlapping butt seam of the donor belt.

The seam is formed by aligning the overlapping sections as in FIG. 5 and using heat and pressure to melt and flow a small region of the thermoplastic layers such that it solidifies to form a thermoplastic welded interface. The seam should be as smooth as possible in order to prolong belt life.

A preferred joining means includes ultrasonic welding to transform the donor sheet into a donor belt. The belt can be fabricated by ultrasonic welding of the overlapped opposite end regions of a sheet. In the ultrasonic seam welding process, ultrasonic energy applied to the overlap region is used to melt the thermoplastic layer. Alternatively, microwave energy and compressive pressure can be used to form the seam. Combinations of energy types can be used in cooperation to melt and flow the thermal plastic materials at the seam interface, for example thermal and microwave heating may be used in combination with compression pressure to enable the seam formation process to occur rapidly and reliably. Furthermore, direct fusing of the support layer and optionally followed by a longer time and or programmed post weld heat treatment or annealing can be used to achieve optimum seam strength.

In practice, the height of the rectangle cut out from the first end $H_1$ will always be less than the thickness of the thermoplastic layer $T_1$, i.e. $H_1<T_1$. The planar cut defined by the rabbet surfaces 403 and 404 can be made anywhere within the thickness of the thermoplastic layer, but is preferably positioned in the middle of the thermoplastic layer as this will provide wide manufacturing process latitudes. Since the material that is in contact within the overlapping region of the seam will flow and bond together, it is desirable to have sufficient remaining thickness of thermoplastic on each end of the substrate to enable a continuous interlayer after the bonding process.

FIG. 5 shows the seam region of the donor belt composed of the two joined ends of a multi-layer substrate. The first end 500 and second end 510 have a horizontal overlap 505 of length O. Two vertical gaps 515 and 520 also exist having a width W which is included in the overlap O. While the vertical gaps are not necessarily of equal width, the difference is insignificant and they are treated as equal here. It is desirable to optimize the overlap length O in order to achieve sufficient contact area between the two ends to yield maximal strength. Typically the overlap length O is equal to or greater than the belt thickness T. In general, larger contact areas enable mechanical stresses to be distributed over a greater area, thereby providing a high degree of strength to the seam region. Similarly, it is desirable to minimize the width of the vertical gap W for two reasons. A small gap enhances the possibility of capillary wicking of molten polymer into the gap during the bonding process, resulting in a more secure bonded seam. In addition, a small gap within the upper layer facilitates the inter-meshing of molten polymer from and between the outer surfaces that define the vertical walls of the gap. Further, the presence of polymer everywhere in the gaps prevents toner particles or other dirt from seeping into the gap during use, which may weaken the seam. The overlap length O should be long with respect to the total film thickness T, where $T=T_1+T_2$. This minimizes the undesired impacts of minor mechanical and electrical discontinuities associated with the seam. Generally, $0.2T \leqq O \leqq 1000T$. The vertical gap W before the seam bonding process should be a small as possible with respect to the thickness of the thermoplastic layer $T_1$ as this will enable consistent filling of the gap during the seam bonding process. Generally, $0 \leqq W \leqq 0.5T_1$.

Furthermore, FIG. 5 illustrates the cross-sectional side view of an embodiment directed to an enhanced seam design formed by an ultrasonic welding process. In this view, a flexible donor belt 500 is shown after material has been removed or displaced from both ends of a flexible, substantially rectangular sheet on a substantially 90° angle to form two new angled, complementary, cross-sectional ends, 510 and 520. The sheet is then formed into a loop, the two new matching or complementary angled cross-sectional ends 510 and 520 are overlayed upon one another and/or mated, and subsequently joined together or fused, such as by an ultrasonic welding process, to form a seam area. Generally, angles less than and greater than 90° having a sum of angles of approximately 180°, for example from 30° to 150°, may be used to form the angled, complementary ends 510 and 520. If for example 30° were used for the angle of surface 510, then an angle of 180−30=150° would be chosen for the angle of surface 520.

A layer of electrodes is placed on top of the thermoplastic layer. The electrodes extend substantially across the width of the surface of the donor belt. These electrodes may be used to transport toner as described in U.S. Pat. Nos. 5,717,986 and 5,893,015, which are hereby entirely incorporated by reference. The electrodes may also be used to apply local surface potentials that can be used to charge toner or detach toner from the donor belt in order to develop the electrostatic latent image recorded on the charge retentive surface.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A donor belt having a first end and a second end, comprising:

a thermoplastic upper layer having a thickness $T_1$;

a conductive lower layer having a thickness $T_2$; and a plurality of spaced electrodes extending substantially across the width of the surface of the donor belt;

wherein said first end includes a first tongue formed by removing a rectangle having a length $L_1$ and a height $H_1$, and wherein $H_1<T_1$;

wherein said second end includes a second tongue formed by removing a rectangle having a length $L_2$ and a height $H_2$, and wherein $H_2 \geqq H_1$;

and wherein said first tongue and said second tongue are joined together to form an overlapping butt seam.

2. The donor belt of claim 1, wherein said thermoplastic layer is comprised of a material selected from the group consisting of polystyrene, polyester, polybutyl terepthalate, polyetheretherketone, polyamide, polyethersulphone, polycarbonate, polyphenylsulfide, polypropylene, polyethylene, polyurethane, copolymers, and combinations thereof.

3. The donor belt of claim 1, wherein said lower layer is comprised of a material selected from the group consisting of polyesters, polyurethanes, polyimides, epoxies, crosslinking polyolefins, polyamides, polycarbonates, acrylics, and combinations thereof.

4. The donor belt of claim 1, wherein said thermoplastic upper layer is comprised of a polyimide and wherein said lower layer is comprised of a polyimide.

5. The donor belt of claim 1, wherein said thermoplastic upper layer comprises a polyimide and wherein said lower layer comprises a polycarbonate or polyester.

6. The donor belt of claim 1, wherein said overlapping butt seam defines a horizontal overlap of length O; wherein the total film thickness T is defined by the sum of the thicknesses of said thermoplastic layer and said lower layer; and wherein $0.2T \leqq O \leqq 1000T$.

7. The donor belt of claim 1, wherein an adhesive layer is placed between the lower layer and the thermoplastic layer.

8. The donor belt of claim 7, wherein said adhesive layer is an adhesive selected from the group consisting of methacrylate resins, methacrylate copolymer resins, ethyl methacrylate resins, butyl methacrylate resins, polyesters, polyvinylbutyral, polyvinylpyrrolidone, polyurethane, polymethyl methacrylate and mixtures thereof.

9. The donor belt of claim 1, wherein the thickness of said thermoplastic layer ranges from about 0.1 mils to about 10 mils.

10. The donor belt of claim 1, wherein the thickness of said lower layer ranges from about 0.1 mils to about 10 mils.

11. The donor belt of claim 1, wherein said thermoplastic layer is thicker than said lower layer.

12. The donor belt of claim 1, wherein $L_1$ and $L_2$ are substantially equal.

* * * * *